United States Patent [19]

Osborn et al.

[11] Patent Number: 4,940,435

[45] Date of Patent: Jul. 10, 1990

[54] MARINE PROPULSION DEVICE

[75] Inventors: Harold L. Osborn, Winthrop Harbor; Matthew H. Mondek, Wonder Lake, both of Ill.; John C. Hervat, Kenosha, Wis.; Roger B. Whipple, Grayslake, Ill.

[73] Assignee: Outboard Marine Corporation, Waukegan, Ill.

[21] Appl. No.: 183,894

[22] Filed: Apr. 20, 1988

[51] Int. Cl.[5] ..... B63H 21/32

[52] U.S. Cl. ..... 440/89; 123/55 VE; 123/65 E; 60/313

[58] Field of Search ..... 440/88, 89; 60/31, 32, 60/273, 312, 314; 123/52 M, 55 VE, 65 E; 181/235, 272

[56] References Cited

U.S. PATENT DOCUMENTS

| | | | |
|---|---|---|---|
| 3,045,423 | 7/1962 | Hulsebus | 440/89 |
| 3,198,162 | 8/1965 | Larsen | 440/89 |
| 3,282,373 | 7/1965 | Gazzara | 181/39 |
| 3,296,997 | 1/1967 | Hoiby et al. | 440/89 |
| 3,310,022 | 3/1967 | Kollman | 440/88 |
| 3,350,879 | 11/1967 | Boda et al. | 440/89 |
| 3,520,270 | 7/1970 | Miller | 440/89 |
| 3,577,952 | 5/1971 | Tado | 440/89 |
| 3,692,006 | 9/1972 | Miller et al. | 123/55 VE |
| 3,695,238 | 10/1972 | Boerma | 123/65 E |
| 3,772,887 | 11/1973 | Ziegler | 60/313 |
| 3,911,852 | 10/1975 | Miller et al. | 440/89 |
| 3,967,446 | 7/1976 | Harralson et al. | 60/312 |
| 4,019,456 | 4/1977 | Harbert | 440/89 |
| 4,036,162 | 7/1977 | Maier et al. | 440/89 |
| 4,145,988 | 3/1979 | Harada | 440/89 |
| 4,303,401 | 12/1981 | Sanmi et al. | 440/88 |
| 4,337,054 | 6/1982 | Holtermann et al. | 440/89 |
| 4,354,849 | 10/1982 | Sanmi et al. | 440/88 |
| 4,421,490 | 12/1983 | Nakahama | 440/89 |
| 4,507,092 | 3/1985 | Hall et al. | 440/89 |
| 4,589,852 | 5/1986 | Price | 440/89 |
| 4,604,069 | 8/1986 | Taguchi | 440/88 |
| 4,607,723 | 8/1986 | Okazaki | 181/272 |
| 4,660,378 | 4/1987 | Scharpf | 60/313 |
| 4,668,199 | 5/1987 | Freund et al. | 440/89 |

*Primary Examiner*—Joseph F. Peters, Jr.
*Assistant Examiner*—Jesûs D. Sotelo
*Attorney, Agent, or Firm*—Michale, Best & Friedrich

[57] ABSTRACT

A marine propulsion device comprising a propulsion unit including an internal combustion engine, the engine comprising a cylinder, a water jacket, a water jacket inlet port communicating with the water jacket, and a lower face having therein an exhaust outlet port communicating with the cylinder, the propulsion unit also including a drive shaft housing having a lower end, a gearcase connected to the lower end of the drive shaft housing, a propeller rotatably supported by the gearcase, a drive shaft which extends through the drive shaft housing and which includes an upper end driven by the engine and a lower end drivingly connected to the propeller, and an exhaust housing located at least partially within the drive shaft housing and connected to the lower face of the engine, the exhaust housing comprising an exhaust passage located interiorly of the exhaust housing and communicating with the exhaust outlet port, a water intake port, and a water intake passage located interiorly of the exhaust housing and communicating between the water intake port and the water jacket inlet port, and a water pump having an outlet communicating with the water intake port.

36 Claims, 3 Drawing Sheets

MARINE PROPULSION DEVICE

RELATED APPLICATIONS

Attention is directed to the following U.S. patent applications, all of which are assigned to the assignee of this application:

| Inventor | Ser. No. | Filed |
|---|---|---|
| Towner | 106,118 | October 7, 1987 |
| Broughton | 062,435 | June 12, 1987 |
| Binversie | 058,365 | June 4, 1987 |
| Poehlman | 053,112 | May 21, 1987 |
| Wenstadt | 754,534 | July 12, 1985 |

BACKGROUND OF THE INVENTION

The invention relates to marine propulsion devices, and, more particularly, to marine propulsion devices including a drive shaft housing which supports an engine, and an exhaust housing located within the drive shaft housing and connected to the engine.

A typical outboard motor includes an engine, a drive shaft housing, an adaptor to which both the engine and the drive shaft housing are connected and which is sandwiched between the engine and the drive shaft housing, and an exhaust housing connected to the lower face of the adaptor and extending within the drive shaft housing. This arrangement provides a joint between the engine and the adaptor, a joint between the adaptor and the drive shaft housing, and a joint between the adaptor and the exhaust housing. Typically, cooling water for the engine is pumped upwardly through the adaptor and is pumped upwardly to the adaptor either through a conduit located inside the drive shaft housing and outside the exhaust housing or through a passageway inside the exhaust housing.

It is known to tune the exhaust of such an outboard motor by providing the exhaust housing with a specially constructed exhaust passage. See, for example, Holtermann, et al. U.S. Pat. No. 4,337,054. Furthermore, it is known to provide such an outboard motor with an idle exhaust relief system that discharges exhaust gases above the water level when the outboard motor is operating at idle or low speeds.

Attention is directed to the following U.S. Patents:

| Inventor | U.S. Pat. No. | Issued |
|---|---|---|
| Scharpf | 4,660,378 | April 28, 1987 |
| Holtermann | 4,337,054 | January 29, 1982 |
| Ziegler | 3,772,887 | November 20, 1973 |
| Boerma | 3,695,238 | October 3, 1972 |
| Miller | 3,692,006 | September 19, 1972 |
| Hulsebus | 3,045,423 | July 24, 1962 |
| Larsen | 3,198,162 | August 3, 1965 |
| Gazzara | 3,282,373 | November 1, 1966 |
| Hoiby et al. | 3,296,997 | January 10, 1967 |
| Kollman | 3,310,022 | March 21, 1967 |
| Boda et al. | 3,350,879 | November 7, 1967 |
| Miller | 3,520,270 | July 14, 1970 |
| Tado | 3,577,952 | May 11, 1971 |
| Miller et al. | 3,911,852 | October 14, 1975 |
| Harralson et al. | 3,967,446 | July 6, 1976 |
| Maier et al. | 4,036,162 | July 19, 1977 |
| Harbert | 4,019,456 | April 26, 1977 |
| Harada | 4,145,988 | March 27, 1979 |
| Sanmi et al. | 4,303,401 | December 1, 1981 |
| Sanmi et al. | 4,354,849 | October 19, 1982 |
| Nakahama | 4,421,490 | December 20, 1983 |
| Hall et al. | 4,507,092 | March 26, 1985 |

-continued

| Inventor | U.S. Pat. No. | Issued |
|---|---|---|
| Price | 4,589,852 | May 20, 1986 |
| Taguchi | 4,604,069 | August 5, 1986 |
| Okazaki | 4,607,723 | August 26, 1986 |
| Freund et al. | 4,668,199 | May 26, 1987 |

Attention is also directed to the following Japanese patent applications:

| Appl. No. | Filed |
|---|---|
| 54-25059 | March 6, 1979 |
| 55-133541 | September 25, 1980 |
| 55-155500 | November 5, 1980 |
| 55-156562 | November 7, 1980 |
| 57-68908 | April 24, 1982. |

SUMMARY OF THE INVENTION

The invention provides an exhaust housing for use with a marine propulsion device including a drive shaft housing, and an internal combustion engine including an engine block, the engine block including a cylinder, and a lower face having therein an exhaust outlet port communicating with the cylinder, the exhaust housing being adapted to be located at least partially within the drive shaft housing and comprising an upper face adapted to mate with the lower face of the engine block, and an exhaust passage located interiorly of the exhaust housing and adaPted to communicate with the exhaust outlet port.

In one embodiment, the engine also includes a water jacket, the lower face has therein a water jacket inlet port communicating with the water jacket, and the exhaust housing also comprises a water intake port, and a water intake passage located interiorly of the exhaust housing and having a first end communicating with the water intake port, and a second end adapted to communicate with the water jacket inlet port.

The invention also provides an exhaust housing for use with a marine propulsion device including a drive shaft housing, and an internal combustion engine including a cylinder, and a lower face having therein an exhaust outlet port communicating with the cylinder, the exhaust housing being adapted to be located at least partially within the drive shaft housing so that the exhaust housing and the drive shaft housing define therebetween a water jacket, and the exhaust housing comprising an upper face adapted to be connected to the lower face of the engine, an exhaust passage located interiorly of the exhaust housing and adapted to communicate with the exhaust outlet port, a rear wall, a side wall extending transversely to the rear wall, an overflow port located in the side wall, a water discharge port, and a water discharge passage located interiorly of the exhaust housing and communicating between the overflow port and the water discharge port, the water discharge passage being defined in part by the rear wall.

The invention also provides an exhaust housing for use with a marine propulsion device including a drive shaft housing, and an internal combustion engine including a cylinder, and a lower face having therein an exhaust outlet port communicating with the cylinder, an idle exhaust inlet port, and an idle exhaust outlet port, and the engine also including an idle exhaust passage communicating between the idle exhaust inlet port and the idle exhaust outlet port, the exhaust housing being adapted to be located at least partially within the drive shaft housing and comprising an upper face adapted to be connected to the lower face of the engine, an exhaust passage located interiorly of the exhaust housing and adapted to communicate with the exhaust outlet port, an idle exhaust outlet port, a first idle exhaust passage communicating with the exhaust passage and adapted to communicate with the engine idle exhaust inlet port, and a second idle exhaust passage adapted to communicate with the engine idle exhaust outlet port and communicating with the exhaust housing idle exhaust outlet port.

The invention also provides an exhaust housing assembly for use with a marine propulsion device including a drive shaft housing, and an internal combustion engine including a cylinder, and a lower face having therein an exhaust outlet port communicating with the cylinder, the exhaust housing assembly being adapted to be located at least partially within the drive shaft housing, and the assembly comprising an exhaust housing including an upper face adapted to be connected to the lower face of the engine, an exhaust passage located interiorly of the exhaust housing and adapted to communicate with the exhaust outlet port, and an idle exhaust outlet port communicating with the exhaust passage when the exhaust housing is connected to the engine, and muffler means removably mounted on the exhaust housing and communicating with the idle exhaust outlet port.

The invention also provides an exhaust housing for use with a marine propulsion device including a drive shaft housing having an upper end, and an internal combustion engine including a cylinder, and a lower face having therein an exhaust outlet port communicating with the cylinder, the exhaust housing being adapted to be located partially within the drive shaft housing, and the exhaust housing having an upper end and comprising an upper face adapted to be connected to the lower face of the engine, a flange portion located adjacent the upper end of said exhaust housing, the flange portion being adapted to be sandwiched between the upper end of the drive shaft housing and the engine, and an exhaust passage located interiorly of the exhaust housing and adapted to communicate with the exhaust outlet port.

The invention also provides an internal combustion engine comprising a cylinder, and a lower face having therein an exhaust outlet port communicating with the cylinder, an idle exhaust inlet port, and an idle exhaust outlet port, and the engine also comprising an idle exhaust passage communicating between the idle exhaust inlet port and the idle exhaust outlet port.

The invention also provides a marine propulsion device comprising an engine and exhaust housing assembly including an internal combustion engine, the engine comprising a cylinder, and a lower face having therein an exhaust outlet port communicating with the cylinder, and the assembly also including an exhaust housing connected to the lower face of the engine, the exhaust housing comprising a continuous, folded exhaust passage located interiorly of the exhaust housing and including a first generally vertical passage portion having an upper end communicating with the exhaust outlet port, and having a lower end, and a second generally vertical passage portion having a lower end communicating with the lower end of the first portion, the exhaust housing also comprising an exhaust outlet located adjacent the lower end of said exhaust housing and communicating with the folded exhaust passage, and an idle exhaust outlet port, and the assembly further including exhaust passage means extending interiorly of the assembly and communicating between the first passage portion and the idle exhaust outlet port, and the marine propulsion device also comprising a drive shaft housing having a lower end, a gearcase connected to the lower end of said drive shaft housing, a propeller rotatably supported by the gearcase, and a drive shaft which extends through the drive shaft housing and which includes an upper end driven by the engine and a lower end drivingly connected to the propeller.

A principal feature of the invention is the provision of a marine propulsion device comprising an engine block including a lower face, and an exhaust housing including an upper face mating with the lower face of the engine block. In other words, the invention provides an integral adaptor and exhaust housing, i.e., there is no separate adaptor between the engine block and the exhaust housing.

Another principal feature of the invention is the provision of a marine propulsion device as described above wherein the exhaust housing includes a water intake port, and a water intake passage located interiorly of the exhaust housing and communicating between the water intake port and the inlet port for the engine water jacket, and wherein the device also comprises a water Pump having an outlet communicating with the water intake port. This arrangement eliminates the need for separate conduit located outside of the exhaust housing.

Another principal feature of the invention is the provision of a marine propulsion device comprising an exhaust housing located within a drive shaft housing so that the exhaust housing and the drive shaft define therebetween a water jacket, the exhaust housing including a side wall, an overflow port located in the side wall, a water discharge port, and a water discharge passage located interiorly of the exhaust housing and communicating between the overflow port and the water discharge port.

Another principal feature of the invention is the provision of a marine propulsion device comprising an internal combustion engine including a lower face having therein an idle exhaust inlet port, and an idle exhaust outlet Port, and the engine also including an idle exhaust passage communicating between the idle exhaust inlet port and the idle exhaust outlet port, and an exhaust housing connected to the lower face of the engine and including a main exhaust passage, an idle exhaust outlet port, a first idle exhaust passage communicating between the main exhaust passage and the engine idle exhaust inlet port, and a second idle exhaust passage communicating between the engine idle exhaust outlet port and the exhaust housing idle exhaust outlet port.

Another principal feature of the invention is the provision of a marine propulsion device comprising an exhaust housing including an idle exhaust outlet port, and muffler means removably mounted on the exhaust housing and communicating with the idle exhaust outlet port. This arrangement permits adjustment of the muffler means to provide different noise characteristics with the same engine or to provide the same noise characteristics with different engines. More particularly, the muffler means includes a tube having a length and cross-sectional area that can be adjusted.

Another principal feature of the invention is the provision of a marine propulsion device comprising an engine, an exhaust housing having an upper end and a flange portion located adjacent the upper and, a drive shaft housing having an upper end, and means for sandwiching the exhaust housing flange portion between the upper end of the drive shaft housing and the engine. This arrangement eliminates the above-described joints between the drive shaft housing and the adaptor and between the exhaust housing and the adaptor. This both reduces the possibility of leakage and allows for better control of the position of the exhaust housing relative to the drive shaft housing.

Another principal feature of the invention is the provision of a "dry" idle exhaust relief system that successfully attenuates engine idle exhaust noise. The exhaust relief system is referred to as "dry" because water is not intentionally introduced into the exhaust. The absence of water in the exhaust both reduces corrosion and decreases back pressure.

Other features and advantages of the invention will become apparent to those skilled in the art upon review of the following detailed description, claims and drawings.

Figure 7:
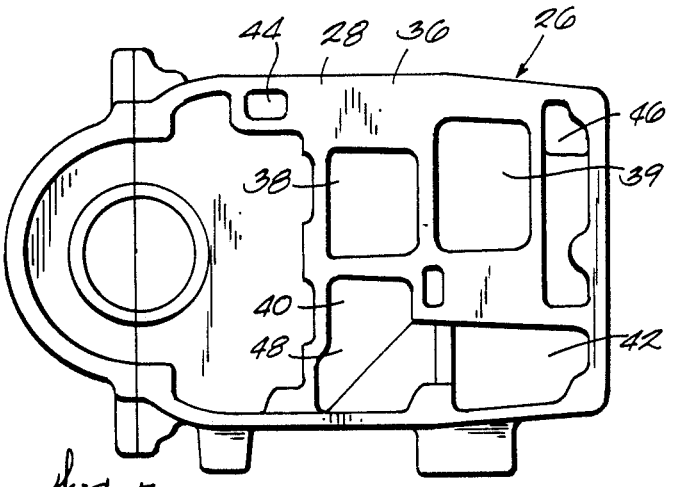
FIG. 7 is a bottom view of the engine.
Figure 6:
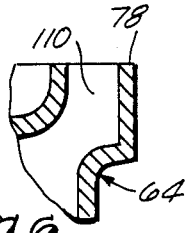
FIG. 6 is a view taken along line 6—6 in FIG. 2.
Figure 5:
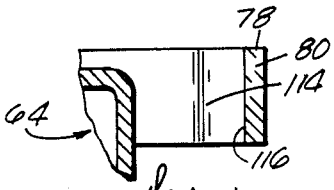
FIG. 5 is a view taken along line 5—5 in FIG. 2.
Figure 2:
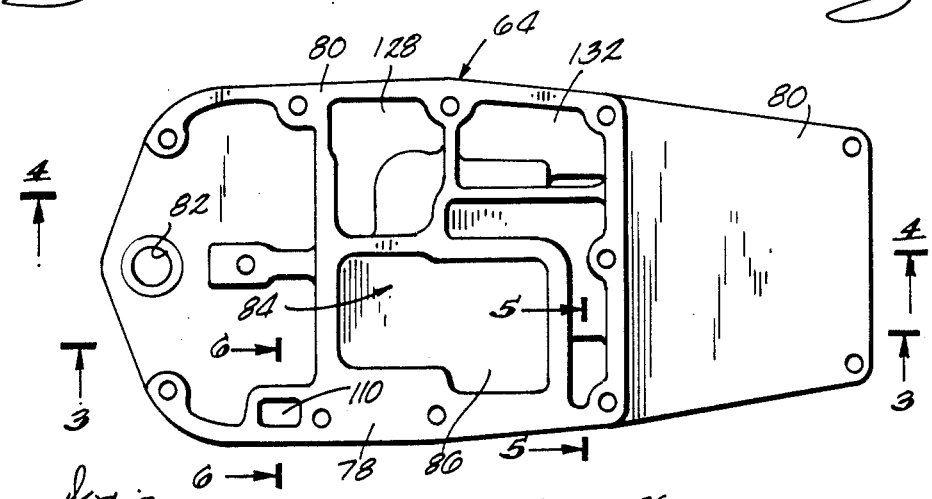
FIG. 2 is a top view of the exhaust housing.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in FIGS. 1 through 7. While the illustrated marine propulsion device 10 is an outboard motor, it should be understood that at least some of the advantages of the invention are obtainable with other types of marine propulsion devices, such as stern drive units.

Figure 1:
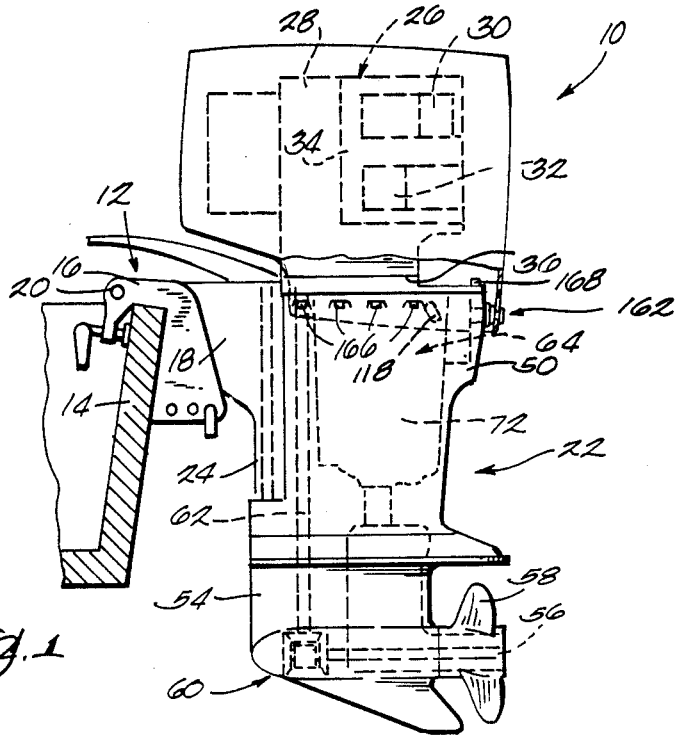
FIG. 1 is a side elevational view of a marine propulsion device embodying the invention and comprising an engine and an exhaust housing.
Figure 4:
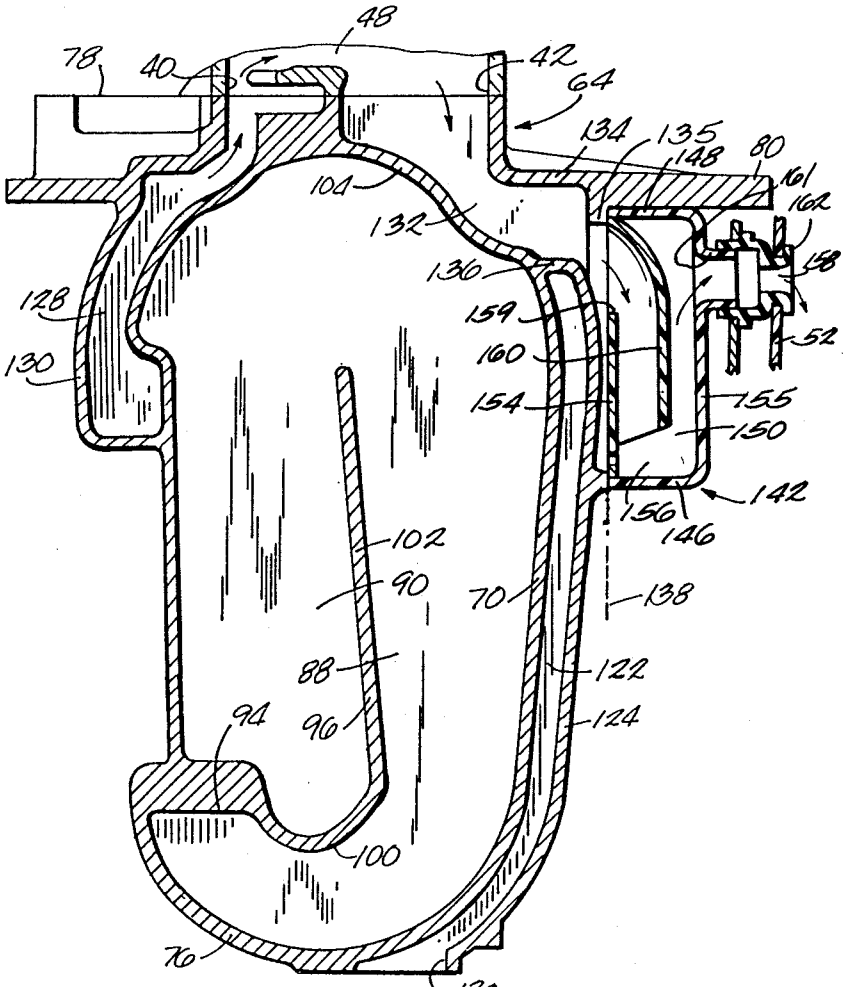
FIG. 4 is a view taken along line 4—4 in FIG. 2.
Figure 3:
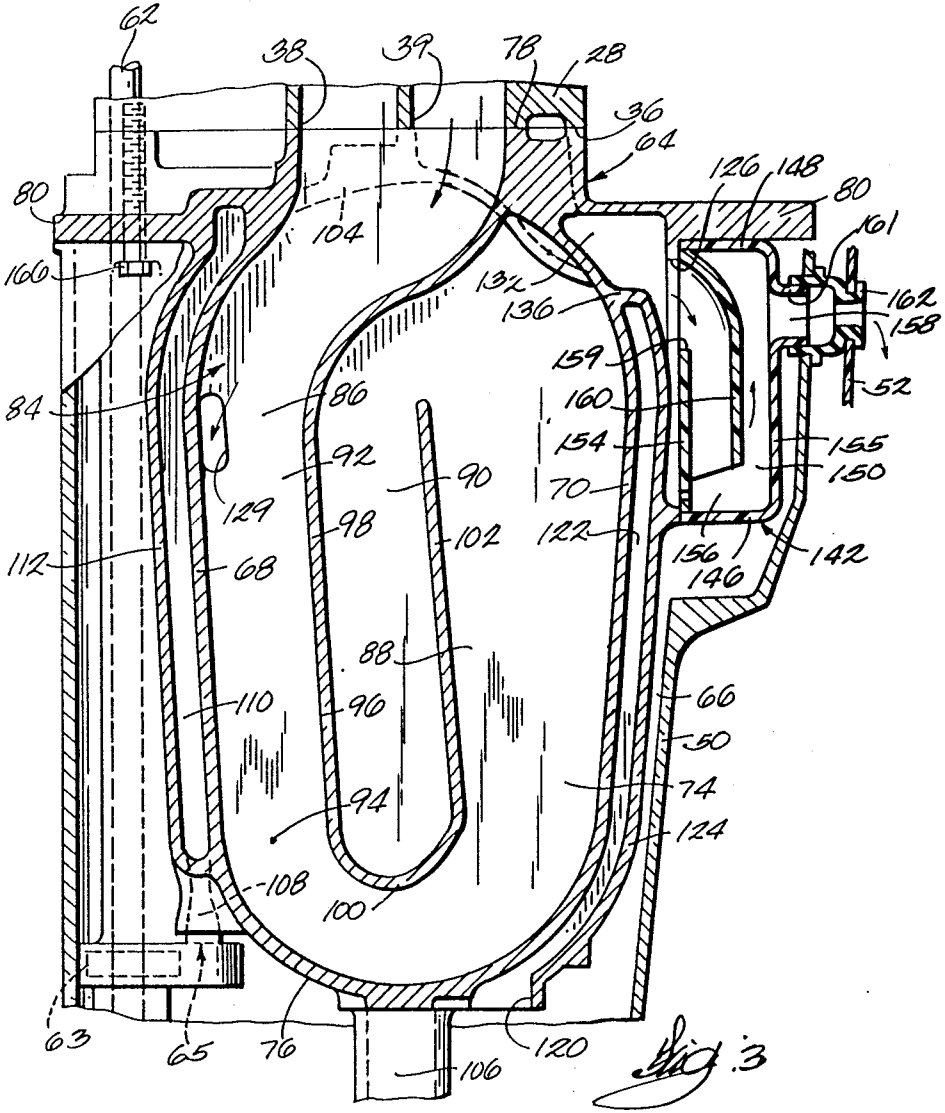
FIG. 3 is a view taken along line 3—3 in FIG. 2.

As shown in FIG. 1, the marine propulsion device 10 comprises a mounting assembly 12 mounted on the transom 14 of a boat. While various suitable mounting assemblies can be employed, in the preferred embodiment, the mounting assembly 12 includes a transom bracket 16 fixedly mounted on the transom 14, and a swivel bracket 18 mounted on the transom bracket 16 for pivotal movement relative thereto about a generally horizontal tilt axis 20.

The marine propulsion device 10 also comprises a propulsion unit 22 mounted on the swivel bracket 18 for pivotal movement relative thereto about a generally vertical steering axis 24. The propulsion unit 22 comprises an internal combustion engine 26 defined, in part, by an engine block 28 including upper and lower cylinders 30 and 32, respectively, a water jacket 34 surrounding the cylinders 30 and 32, and a lower face 36 having therein exhaust outlet ports 38 and 39 communicating with the cylinders 30 and 32, respectively, an idle exhaust inlet port 40, an idle exhaust outlet port 42, a water jacket inlet port 44 communicating with the water jacket 34, and a water jacket outlet port 46 communicating with the water jacket 34. The engine block 28 also includes an idle exhaust passage 48 communicating between the idle exhaust inlet port 40 and the idle exhaust outlet port 42. More particularly, the engine block 28 is formed with a void or chamber which, in part, is located adjacent the water jacket 34, which forms the idle exhaust passage 48 and which opens into the lower face 36 of the engine block 28 through the idle exhaust inlet and outlet ports 40 and 42.

The propulsion unit 22 also comprises a drive shaft housing 50 which has upper and lower ends. The propulsion unit 22 also comprises a cowling or cover 52 surrounding the engine 26 and the upper end of the drive shaft housing 50. The propulsion unit 22 also comprises a gearcase 54 which is connected to the lower end of the drive shaft housing 50 and which rotatably supports a propeller shaft 56 carrying a propeller 58. The propeller shaft 56 is connected via a reversing transmission 60 to a drive shaft 62 which extends through the drive shaft housing 50 and which is driven by the engine 26. The drive shaft 62 also extends through and drives a water pump 63 having an outlet 65, as is known in the art.

The propulsion unit 22 also comprises an exhaust housing 64 which has upper and lower ends and which is located partially within the drive shaft housing 50 so that the exhaust housing 64 and the drive shaft housing 50 define therebetween a second or lower water jacket 66. The lower end of the exhaust housing 64 is sealingly connected to the drive shaft housing 50 to provide a water-tight bottom to the lower water jacket 66, except as will be explained hereinafter. The exhaust housing 64 comprises front and rear walls 68 and 70, respectively, spaced side walls 72 and 74 extending between the front and rear walls 68 and 70, a curved bottom wall 76 connected to the walls 68, 70, 72 and 74, and an upper face 78 mating with the lower face 36 of the engine 26. The exhaust housing 64 also comprises a flange portion 80 located adjacent the upper end of the exhaust housing 64. In the preferred embodiment, the drive shaft 62 extends through an aperture 82 in the flange portion 80 of the exhaust housing 64.

The exhaust housing 64 also comprises a continuous, folded exhaust passage 84 located interiorly of the exhaust housing 64 and including a first generally vertical passage portion 86 having an upper end communicating with the engine exhaust outlet ports 38 and 39, and having a lower end, a second generally vertical passage portion 88 having a lower end communicating with the lower end of the first portion 86, and having an upper end, and a third generally vertical passage portion 90 having an upper end communicating with the upper end of the second portion 88.

The first passage portion 86 initially extends from a major cross-sectional area at the top and then, after passing through a minimum cross-sectional area, ex-Pands toward the bottom of the exhaust housing 64. While other constructions could be emPloyed, in the illustrated construction, the first portion 86 is defined by the front wall 68, by the side wall 72, by a wall 92 which extends rearwardly from the front wall 68 and which extends generally parallel to and between the side walls 72 and 74 from the upper face 78 to a point 94 adjacent the lower end of the transverse wall 96 which extends generally parallel to and rearwardly of the front wall 68.

The transverse wall 96 extends between the side wall 72 and the wall 92 between the upper face 78 and the above-mentioned point 94, and extends between the side walls 72 and 74 thereafter. The transverse wall 96 includes a first generally vertical portion 98 extending downwardly from the upper face 78, a curved portion 100 that is generally concentric with and spaced from the bottom wall 76, and a second generally vertical portion 102 extending upwardly from the curved portion 100 to a point below the upper end of the housing 64.

The second passage portion 88 generally continuously expands and is defined by the side walls 72 and 74, by the second portion 102 of the wall 96, by the rear wall 70, and by an arcuate wall 104 which joins the upper end of the rear wall 70 and the upper end of the front wall 68 and which extends between the side wall 74 and the wall 92 forwardly of the wall 96 and between the side wall 74 and the side wall 72 rearwardly of the wall 96. The arcuate wall 104 directs gas from the upPer end of the second passage portion 88 downwardly into the third passage portion 90.

The third passage Portion 90 is defined by the second portion 102 of the transverse wall 96, by the front wall 68, by the side wall 74, by the wall 92, and by the side wall 72 rearwardly of the wall 92.

The exhaust housing 64 also comprises an exhaust outlet 106 located adjacent the lower end of the exhaust housing 64 and communicating with the folded exhaust passage 84 adjacent the lower end of the first Passage portion 86. The exhaust gas outlet 106 communicates with the exhaust passage 84 through the curved bottom wall 76, and communicates with an exhaust passage (not shown) in the gearcase 54, as is known in the art.

The exhaust housing 64 also comprises a water intake port 108 located adjacent the lower end of the exhaust housing 64 and communicating with the pump outlet 65, and a water intake passage 110 located interiorly of the exhaust housing 64 and communicating between the water intake port 108 and the water jacket inlet port 44. In the illustrated construction, the intake passage 110 is defined in Part by the front wall 68 and by a wall 112 which is semi-circular in cross-section and which extends forwardly from the front wall 68.

The exhaust housing 64 also comprises (see FIGS. 2 and 5) a water drainage or outlet passage 114 which extends through the flange portion 80. The passage 114 has an upper end which communicates with the water jacket outlet port 46, and a lower end which terminates in a port 116 that serves to dump coolant discharge from the engine block 28 into the second or lower water jacket 66.

The exhaust housing 64 also comprises an overflow port 118 (FIG. 1) located in the side wall 72 and communicating with the lower water jacket 66, a water discharge port 120 located adjacent the lower end of the exhaust housing 64 and adapted to communicate with discharge ports (not shown) in the drive shaft housing 50 or gearcase 54, and a water discharge passage 122 located interiorly of the exhaust housing 64 and communicating between the overflow port 118 and the water discharge port 120. The water discharge passage 122 is defined in part by the rear wall 70 of the exhaust housing, by a wall 124 which extends generally parallel to and rearwardly of the rear wall 68, and by the side walls 72 and 74. At its upper end, the water discharge passage 122 curves forwardly to connect through the side wall 72 with the overflow port 118. The forwardly curving portion of the water discharge passage 122 is formed by the rearward end of the arcuate wall 104 or the upper end of the rear wall 70 and by a forwardly curving portion of the wall 124. Thus, the coolant which collects in the lower water jacket 66 is discharged from the lower water jacket 66 via the overflow port 118, the water discharge passage 122 and the water discharge port 120.

The marine propulsion device 10 also comprises means for affording exhaust gas relief when the engine 26 is operating at idle or low speeds. While various suitable relief means can be employed, in the illustrated construction, the relief means includes an idle exhaust outlet port 126 located in the rear wall 70 of the exhaust housing 64, and passage means extending interiorly of the assembly of the engine 26 and exhaust housing 64 and communicating between the first exhaust passage portion 86 and the idle exhaust outlet port 126.

More particularly, the passage means includes a first idle exhaust passage 128 having a lower end communicating with the first exhaust passage portion 86 through a port 129 adjacent the minimum-area portion of the passage portion 86, and an upper end communicating with the engine idle exhaust inlet port 40. In the illustrated construction, the first passage 128 is defined in part by the front wall 68 and by a wall 130 which is semi-circular in cross-section and which extends forwardly from the front wall 68. The Port 129 is located so as to be above the typical water line (not shown) and sufficiently below the engine 26 so that water from water injection tuning does not negatively affect the relief system.

The passage means also includes the engine idle exhaust passage 48, and, in the exhaust housing 64, a second exhaust passage 132 having an upper end communicating with the engine idle exhaust outlet port 42 and a lower end communicating with the exhaust housing idle exhaust outlet port 126. The second exhaust passage 132 is defined in part by an upper transverse wall 134, by a wall segment 135 extending downwardly from the wall 134, by the rearward portion of the arcuate wall 104, by a lower horizontal wall 136 extending rearwardly from the rear wall 70, and by extensions of the side walls 72 and 74, which extensions extend rearwardly from the rear wall 70 and interconnect the upper and lower walls 134 and 136. The wall segment 135 and the lower and side walls 136, 72 and 74 terminate rearwardly in a common plane 138 and form the outlet 126.

The marine propulsion device 10 further comprises muffler means removably mounted on the exhaust housing 64 and communicating with the exhaust housing idle exhaust outlet port 126. While various suitable muffler means can be used, in the illustrated construction, the muffler means includes a box-like cover 142 removably mounted, such as by bolts (not shown), over the exhaust housing idle exhaust outlet port 126. The cover 142 includes spaced, horizontal upper and lower walls 146 and 148, respectively, spaced, vertical side walls 150 joining the upper and lower walls 146 and 148, and front and rear walls 154 and 155, respectively, joined to the walls 146, 148 and 150 to complete the box-like structure and to form, when mounted on the rear of the exhaust housing 64, an idle relief chamber 156 which is cloSed except for communication with the idle exhaust outlet port 126 and an outlet passage 158 which is described below.

The front wall 154 has therein an inlet port 159 communicating with the exhaust housing idle exhaust outlet port 126, and the cover 142 also includes an integral tube 160 which is formed in part by the front wall 154, which has an upper end communicating with the inlet Port 159, and which has a lower end opening into the idle relief chamber 156. The cover 142 also includes an outlet passage portion 161 which extends rearwardly from the rear wall 155, which defines the outlet passage 158, and which communicates between the idle relief chamber 156 and the atmosphere. The outlet passage portion 161 has thereon a grommet 162 which extends through an opening in the rear wall of the drive shaft housing 50 and through an opening in the motor cover 52, and which sealingly engages the cover 52 and the rear wall of the drive shaft housing 50.

The idle relief passage means provides a series of contractions and expansions which tune the exhaust. More particularly, the first idle exhaust passage 128 forms a contraction relative to the first exhaust passage portion 86, and the engine idle exhaust passage 48 forms an expansion chamber relative to the passage 128. Furthermore, the second exhaust passage 132 and the tube 160 form a contraction relative to the engine idle exhaust passage 48, and the idle relief chamber 156 forms an expansion chamber relative to the tube 160.

Both gas and sound waves enter the port 129 when the engine 26 is operating at idle or low speeds. Upon entering the engine idle exhaust passage 48, the sound waves expand and are reflected by the walls of the passage 48. The sound waves contract upon entering the second exhaust passage 132 and then expand again once in the passage 132. Next, the gas and sound waves pass through the tube 160, the length and diameter of which are preferably sized to attenuate low frequencies associated with engine pulses at idle or low speeds. Finally, the gas and sound waves pass through the outlet passage 158 and the grommet 162 and into the atmosphere.

The marine propulsion device 10 further comprises means for sandwiching the exhaust housing flange portion 80 between the upper end of the drive shaft housing 50 and the lower face 36 of the engine 26. While various suitable sandwiching means can be employed, in the preferred embodiment, the sandwiching means includes a plurality of bolts 166 extending upwardly from the drive shaft housing 50, through the flange portion 80 of the exhaust housing 64 and into the engine block 28. Additionally, the flange portion 80 is connected to the upper end of the drive shaft housing 50 by a pair of bolts 168 extending downwardly from the flange portion 80 and into the upper end of the drive shaft housing 50.

Figure 9:
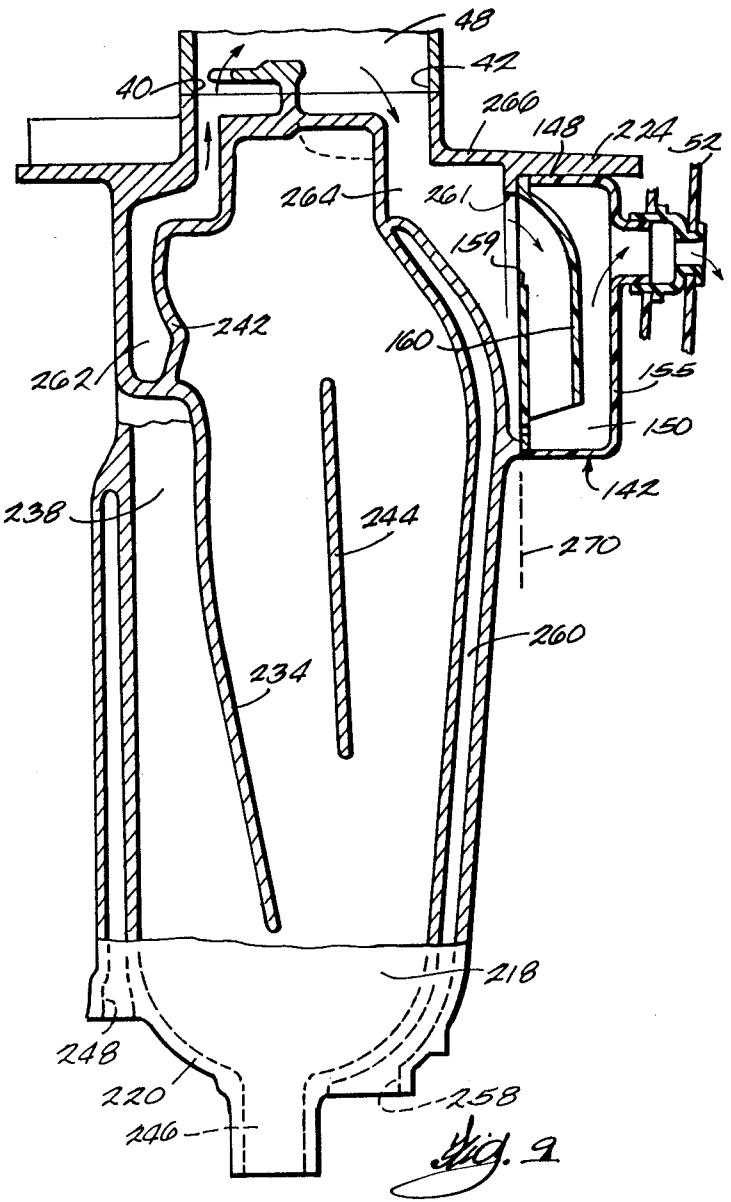
FIG. 9 is a view similar to FIG. 4 and showing the alternative embodiment illustrated in FIG. 8.
Figure 8:
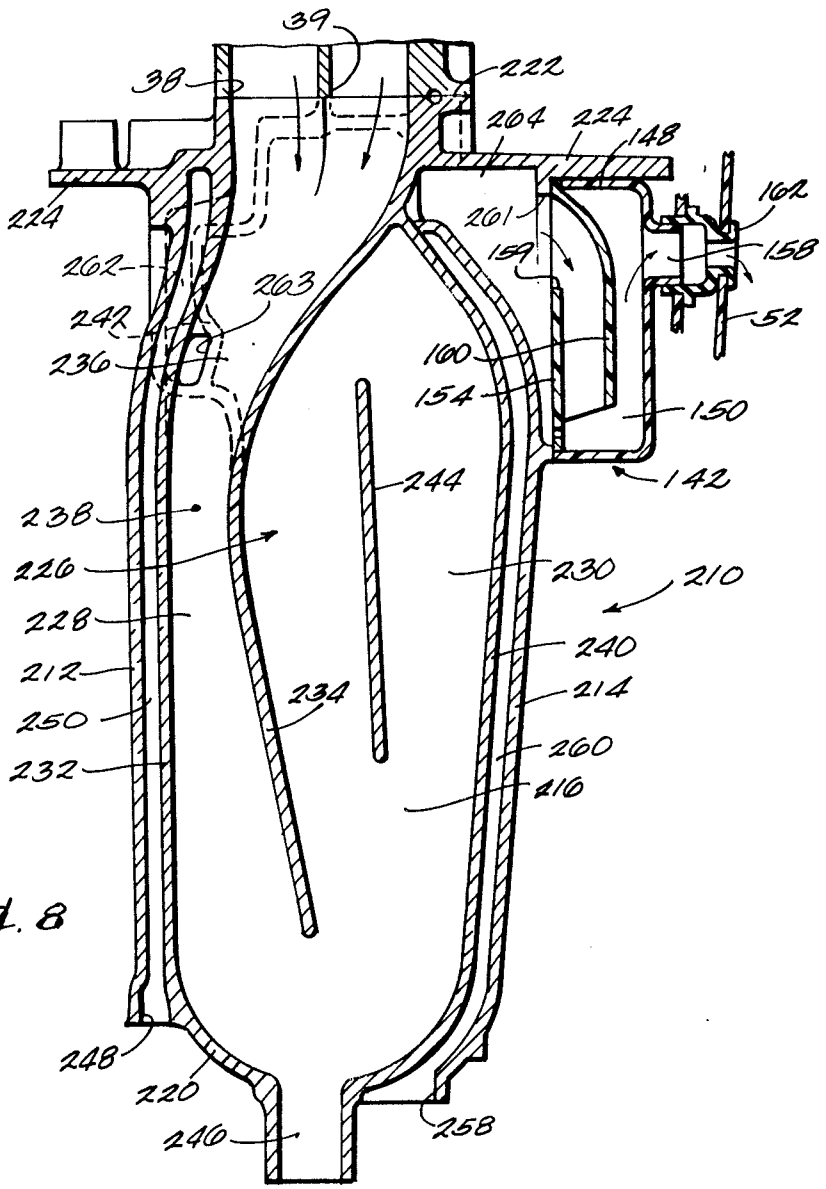
FIG. 8 is a view similar to FIG. 3 and showing an alternative embodiment of the invention.

An alternative embodiment of the invention is illustrated in FIGS. 8 and 9. More particularly, an alternative exhaust housing 210 is illustrated in FIGS. 8 and 9. The exhaust housing 210 is similar in many respects to the exhaust housing 64 of the preferred embodiment, and some common elements have been given the same reference numerals. Furthermore, the top view of the exhaust housing 210 is substantially identical to FIG. 2.

The exhaust housing 210 comprises front and rear walls 212 and 214, respectively, spaced side walls 216 and 218 extending between the front and rear walls 212 and 214, a curved bottom wall 220, and an upper face 222 mating with the lower face 36 of the engine 26. The exhaust housing 210 also comprises a flange portion 224 located adjacent the upper end of the exhaust housing 210.

The exhaust housing 210 also comprises a continuous, folded exhaust Passage 226 located interiorly of the exhaust housing 210 and including a first generally vertical passage portion 228 having an upper end communicating with the engine exhaust outlet ports 38 and 39, and having a lower end, and a second generally vertically passage portion 230 having a lower end communicating with the lower end of the first portion 228. The first Passage portion 228 initially extends from a major cross-sectional area at the top and then, after passing through a minimum cross-sectional area, expands toward the bottom of the exhaust housing 210. While other constructions could be employed, in the illustrated construction, the first passage portion 228 is defined by a transverse wall 232 which extends generally parallel to and rearwardly of the front wall 212, by a transverse wall 234 which extends generally parallel to and rearwardly of the first transverse wall 232, by the side wall 218, by a wall 236 which extends generally parallel to and between the side walls 216 and 218 from the upper face 222 to a point 238 above the horizontal center line of the housing 210, at which point 238 the wall 236 merges with the side wall 216, and by the right side wall 216 below the point 238. The second transverse wall 234 extends between the side wall 218 and the wall 236 between the upper face 222 and the above-mentioned point 238, and extends between the side walls 216 and 218 below the point 238. The second transverse wall 234 terminates in spaced relation to the bottom wall 220 of the exhaust housing 210. The bottom wall 220 directs gas upwardly into the second passage portion 230.

The second passage portion 230 generally continuously expands and is defined by a third transverse wall 240 which extends generally parallel to and forwardly of the rear wall 214, by the transverse wall 234 below the above-mentioned point 238, by a fourth transverse wall 242 which extends generally parallel to and rearwardly of the front wall 212 above the above-mentioned point 238 and which extends between the side wall 216 and the wall 236, by the side wall 216, by the side wall 218 below the above-mentioned point 238, and by the wall 236 above the point 238.

In order to provide stiffness to the exhaust housing 210, a transverse wall segment 244 extends between the side walls 216 and 218 and includes a lower end which terminates at a point above the lower end of the wall 234, and an upper end which terminates at a location below the flange 224. It is noted again that the wall segment 244 serves as a stiffener and is not intended to divide the second exhaust passage portion 230 into two Portions.

The exhaust housing 210 also comprises an exhaust outlet 246 located adjacent the lower end of the exhaust housing 210 and communicating with the folded exhaust passage 226 adjacent the lower end of the first passage portion 228. The exhaust gas outlet 246 communicates with the exhaust passage 226 through the curved bottom wall 220, and communicates with an exhaust passage (not shown) in the gearcase 54, as is known in the art.

The exhaust housing 210 also comprises a water intake port 248 located adjacent the lower end of the exhaust housing 210 and communicating with the pump outlet 65, and a water intake passage 250 located interiorly of the exhaust housing 210 and communicating between the water intake port 248 and the water jacket inlet port 44. In the illustrated construction, the intake passage 250 is defined in part by the first transverse wall 232 and by the front wall 212.

The exhaust housing 210 also comprises a water drainage or outlet passage (not shown) which is substantially identical to the passage 114 of the preferred embodiment and which extends through the flange portion 224. The water drainage passage has an upper end which communicates with the water jacket outlet port 46, and a lower end which terminates in a port that serves to dump coolant discharge from the engine block 28 into the second or lower water jacket 66.

The exhaust housing 210 also comprises an overflow port (not shown) located in the side wall 218 and communicating with the lower water jacket 66, a water discharge port 258 located adjacent the lower end of the exhaust housing 210 and adapted to communicate with discharge ports (not shown) in the drive shaft housing 50 or gearcase 54, and a water discharge passage 260 located interiorly of the exhaust housing 210 and communicating between the overflow port and the water discharge port 258. The water discharge passage 260 is defined in part by the rear wall 214 and by the transverse wall 240. At its upper end, the water discharge passage 260 curves forwardly to connect through the side wall 218 with the overflow port. The forwardly curving portion of the water discharge passage 260 is formed by the wall 240 and by a forwardly curving portion of the rear wall 214 of the exhaust housing 210.

The exhaust housing 210 also comprises a first idle exhaust passage 262 having a lower end communicating with the first exhaust passage portion 228 through a Port 263 adjacent the minimum-area portion of the passage portion 262, and an upper end communicating with the engine idle exhaust inlet port 40. In the illustrated construction, the first idle exhaust passage 262 is defined in part by the front wall 212, by the fourth transverse wall 242, by the side wall 216, and by the wall 236.

The exhaust housing 210 further comprises an idle exhaust outlet port 261 in the rear wall 214, and a second idle exhaust passage 264 having an upper end communicating with the engine idle exhaust outlet port 42, and a lower end communicating with the exhaust housing idle exhaust outlet port 261. The second exhaust passage 264 is defined in part by an upper transverse wall 266, by the upper end of the rear wall 214, by a lower horizontal wall 268 extending rearwardly from the rear wall 214, and by extensions of the side walls 216 and 218, which extensions extend rearwardly from the rear wall 214 and interconnect the upper and lower walls 266 and 268. The upper, lower and side walls 266, 268, 216 and 218 terminate rearwardly in a common plane 270 and form the outlet 261.

Various features of the invention are set forth in the following claims.

We claim:

1. A marine propulsion device comprising a propulsion unit, said propulsion unit including an internal combustion engine comprising an engine block, said engine block including a cylinder, and a lower face having therein an exhaust outlet port communicating with said cylinder, said propulsion unit also including a drive shaft housing having a lower end, a gearcase connected to said lower end of said drive shaft housing, a propeller shaft rotatably supported by said gearcase, a drive shaft which extends through said drive shaft housing and which includes an upper end driven by said engine and a lower end drivingly connected to said propeller shaft, and a one piece exhaust housing located at least partially within said drive shaft housing and comprising an upper face mating with said lower face of said engine block, an outer wall extending downwardly from said upper face, and wall means located interiorly of said outer wall and defining an exhaust interiorly of said outer wall and defining an exhaust passage located interiorly of said outer wall and communicating with said exhaust outlet port.

2. A marine propulsion device as set forth in claim 1 wherein said exhaust housing also includes an upper end, and a flange portion located adjacent said upper end, wherein said drive shaft extends through said flange portion, wherein said drive shaft housing has an upper end, and wherein said marine propulsion device further comprises means for sandwiching said flange portion between said upper end of said drive shaft housing and said engine.

3. A marine propulsion device comprising a propulsion unit including an internal combustion engine comprising an engine block, said engine block including a cylinder, a water jacket, and a lower face having therein an exhaust outlet port communicating with said cylinder, and a water jacket inlet port communicating with said water jacket, said propulsion unit also including a drive shaft housing having a lower end, a gearcase connected to said lower end of said drive shaft housing, a propeller shaft rotatably supported by said gearcase, a drive shaft which extends through said drive shaft housing and which includes an upper end driven by said engine and a lower end drivingly connected to said propeller shaft, an exhaust housing located at least partially within said drive shaft housing and comprising an upper face mating with said lower face of said engine block, and an exhaust passage located interiorly of said exhaust housing and communicating with said exhaust outlet port, a water intake port, and a water intake passage located interiorly of said exhaust housing and communicating between said water intake port and said water jacket inlet port, and a water pump having an outlet communicating with said water intake port.

4. A marine propulsion device comprising a propulsion unit, said propulsion unit including an internal combustion engine comprising an engine block, said engine block including a cylinder, and a lower face having therein an exhaust outlet port communicating with said cylinder, said propulsion unit also including a drive shaft housing having a lower end, a gearcase connected to said lower end of said drive shaft housing, a propeller shaft rotatably supported by said gearcase, a drive shaft which extends through said drive shaft housing and which includes an upper end driven by said engine and a lower end drivingly connected to said propeller, and an exhaust housing located at least partially within said drive shaft housing and comprising an upper face mating with said lower face of said engine block, and a continuous, folded exhaust passage located interiorly of said exhaust housing, communicating with said exhaust outlet port, and including a first generally vertical passage portion having an upper end communicating with said exhaust outlet port, and having a lower end, and a second generally vertical passage portion having a lower end communicating with said lower end of said first portion.

5. A marine propulsion device comprising a propulsion unit including an internal combustion engine comprising an engine block, said engine block including a cylinder, and a lower face having therein an exhaust outlet port communicating with said cylinder, said propulsion unit also including a drive shaft housing having a lower end, a gearcase connected to said lower end of said drive shaft housing, a propeller shaft rotatably supported by said gearcase, a drive shaft which extends through said drive shaft housing and which includes an upper end driven by said engine and a lower end drivingly connected to said propeller shaft, an exhaust housing located at least partially within said drive shaft housing and comprising an upper face mating with said lower face of said engine block, and an exhaust passage located interiorly of said exhaust housing and communicating with said exhaust outlet port, a water jacket defined between said exhaust housing and said drive shaft housing and having a water jacket outlet port, and a water outlet passage located in said exhaust housing and communicating between said water jacket outlet port and said water jacket.

6. A marine propulsion device comprising an internal combustion engine including a cylinder, and a lower face having therein an exhaust outlet port communicating with said cylinder, a drive shaft housing having a lower end, a gearcase connected to said lower end of said drive shaft housing, a propeller rotatably supported by said gearcase, a drive shaft which extends through said drive shaft housing and which includes an upper end driven by said engine and a lower end drivingly connected to said propeller, and an exhaust housing located at least partially within said drive shaft housing so that said exhaust housing and said drive shaft housing define therebetween a water jacket, said exhaust housing being connected to said lower face of said engine and including an exhaust passage located interiorly of said exhaust housing and communicating with said exhaust outlet port, a side wall, an overflow port located in said side wall, a water discharge port, and a water discharge passage located interiorly of said exhaust housing and communicating between said overflow port and said water discharge port.

7. A marine propulsion device as set forth in claim 6 wherein said exhaust housing also includes an upper end, and a flange portion located adjacent said upper end, wherein said drive shaft extends through said flange portion, wherein said drive shaft housing has an upper end, and wherein said marine propulsion device further comprises means for sandwiching said flange Portion between said upper end of said drive shaft housing and said engine.

8. A marine propulsion device as set forth in claim 6 wherein said exhaust passage is a continuous, folded exhaust passage including a first generally vertical passage portion having an upper end communicating with said exhaust outlet port, and having a lower end, and a second generally vertical passage portion having a lower end communicating with said lower end of said first portion.

9. A marine propulsion device as set forth in claim 6 wherein said engine also comprises a second water jacket, and a water jacket outlet port communicating with said second water jacket, and wherein said exhaust housing further includes a water outlet passage communicating between said water jacket outlet port and said first-mentioned water jacket.

10. A marine propulsion device comprising an internal combustion engine including a cylinder, and a lower face having therein an exhaust outlet port communicating with said cylinder, an idle exhaust inlet port, and an idle exhaust outlet port, and said engine also including an idle exhaust passage communicating between said idle exhaust inlet port and said idle exhaust outlet port, a drive shaft housing having a lower end, a gearcase connected to said lower end of said drive shaft housing, a propeller shaft rotatably supported by said gearcase, a drive shaft which extends through said drive shaft housing and which includes an upper end driven by said engine and a lower end drivingly connected to said propeller shaft, and an exhaust housing located at least partially within said drive shaft housing and connected to said lower face of said engine, said exhaust housing including an exhaust passage located interiorly of said exhaust housing and communicating with said exhaust outlet port, an idle exhaust outlet port, a first idle exhaust passage communicating between said exhaust passage and said engine idle exhaust inlet port, and a second idle exhaust passage communicating between said engine idle exhaust outlet port and said exhaust housing idle exhaust outlet port.

11. A marine propulsion device as set forth in claim 10 wherein said exhaust housing also includes an upper end, and a flange portion located adjacent said upper end, wherein said drive shaft extends through said flange portion, wherein said drive shaft housing has an upper end, and wherein said marine propulsion device further comprises means for sandwiching said flange portion between said upper end of said drive shaft housing and said engine.

12. A marine propulsion device as set forth in claim 10 wherein said exhaust passage is a continuous, folded exhaust passage including a first generally vertical passage portion having an upper end communicating with said exhaust outlet port, and having a lower end, and a second generally vertical passage portion having a lower end communicating with said lower end of said first portion.

13. A marine propulsion device as set forth in claim 10 wherein said engine also comprises a first water jacket, and a water jacket outlet port communicating with said first water jacket, wherein said exhaust housing and said drive shaft housing define therebetween a second water jacket, and wherein said exhaust housing further includes a water outlet passage communicating between said water jacket outlet port and said second water jacket.

14. A marine propulsion device comprising a propulsion unit including an internal combustion engine, said engine comprising a cylinder, and a lower face having therein an exhaust outlet port communicating with said cylinder, said propulsion unit also including a drive shaft housing having a lower end, a gearcase connected to said lower end of said drive shaft housing, a propeller rotatably supported by said gearcase, a drive shaft which extends through said drive shaft housing and which includes an upper end driven by said engine and a lower end drivingly connected to said propeller, and an exhaust housing located at least partially within said drive shaft housing and connected to said lower face of said engine, said exhaust housing comprising an exhaust passage located interiorly of said exhaust housing and communicating with said exhaust outlet port, and an idle exhaust outlet port, exhaust passage means communicating between said exhaust passage and said idle exhaust outlet port, and muffler means removably mounted on said exhaust housing and communicating with said idle exhaust outlet port.

15. A marine propulsion device as set forth in claim 14 wherein said exhaust housing also includes an upper end, and a flange portion located adjacent said upper end, wherein said drive shaft extends through said flange portion, wherein said drive shaft housing has an upper end, and wherein said marine propulsion device further comprises means for sandwiching said flange portion between said upper end of said drive shaft housing and said engine.

16. A marine propulsion device as set forth in claim 14 wherein said exhaust passage is a continuous, folded exhaust passage including a first generally vertical passage portion having an upper end communicating with said exhaust outlet port, and having a lower end, and a second generally vertical passage portion having a lower end communicating with said lower end of said first portion.

17. A marine propulsion device as set forth in claim 14 wherein said engine also comprises a first water jacket, and a water jacket outlet port communicating with said first water jacket, wherein said exhaust housing and said drive shaft housing define therebetween a second water jacket, and wherein said exhaust housing further includes a water outlet passage communicating between said water jacket outlet port and said second water jacket.

18. A marine propulsion device as set forth in claim 14 and further comprising a cover surrounding said engine, and wherein said muffler means includes an outlet passage portion communicating with the atmosphere via an opening in said cover.

19. A marine propulsion device comprising a propulsion unit including an internal combustion engine, said engine comprising a cylinder, and a lower face having therein an exhaust outlet port communicating with said cylinder, said propulsion unit also including a drive shaft housing having an upper end and a lower end, a gearcase connected to said lower end of said drive shaft housing, a propeller shaft rotatably supported by said gearcase, a drive shaft which extends through said drive shaft housing and which includes an upper end driven by said engine and a lower end drivingly connected to said propeller shaft, and said propulsion unit also including a one piece exhaust housing located partially within said drive shaft housing and including an upper end having a flange portion, an outer wall extending downwardly from said upper end, and wall means located interiorly of said outer wall and defining an exhaust passage located interiorly of said outer wall and communicating with said exhaust outlet port, and means for sandwiching said exhaust housing flange portion between said upper end of said drive shaft housing and said engine.

20. A marine propulsion device as set forth in claim 19 wherein said drive shaft extends through said flange portion.

21. A marine propulsion device as set forth in claim 19 wherein said sandwiching means includes a plurality of bolts extending from said upper end of said drive shaft housing, through said flange portion of said exhaust housing and into said engine.

22. A marine propulsion device comprising a propulsion unit including an internal combustion engine, said engine comprising a cylinder, and a lower face having therein an exhaust outlet port communicating with said cylinder, said propulsion unit also including a drive shaft housing having an upper end and a lower end, a gearcase connected to said lower end of said drive shaft housing, a propeller shaft rotatably supported by said gearcase, a drive shaft which extends through said drive shaft housing and which includes an upper end driven by said engine and a lower end drivingly connected to said propeller shaft, and said propulsion unit also including an exhaust housing located partially within said drive shaft housing, said exhaust housing having an upper end and comprising a flange portion located adjacent said upper end of said exhaust housing, and a continuous, folded exhaust passage located interiorly of said exhaust housing, communicating with said exhaust outlet port, and including a first generally vertical passage portion having an upper end communicating with said exhaust outlet port, and having a lower end, and a second generally vertical passage portion having a lower end communicating with said lower end of said first portion, and means for sandwiching said exhausting housing flange portion between said upper end of said drive shaft housing and said engine.

23. A marine propulsion device comprising a propulsion unit including an internal combustion engine comprising a cylinder, and a lower face having therein an exhaust outlet port communicating with said cylinder, said propulsion unit also including a drive shaft housing having an upper end and a lower end, a gearcase connected to said lower end of said drive shaft housing, a propeller shaft rotatably supported by said gearcase, a drive shaft which extends through said drive shaft housing and which includes an upper end driven by said engine and a lower end drivingly connected to said propeller shaft, and said propulsion unit also including an exhaust housing located partially within said drive shaft housing, said exhaust housing having an upper end and comprising a flange portion located adjacent said upper end of said exhaust housing, and an exhaust passage located interiorly of said exhaust housing and communicating with said exhaust outlet port, means for sandwiching said exhaust housing flange portion between said upper end of said drive shaft housing and said engine a water jacket defined between said exhaust housing and said drive shaft housing and having a water jacket outlet port, and a water outlet passage located in said exhaust housing and communicating between said water jacket outlet port and said water jacket.

24. A marine propulsion device comprising a propulsion unit including an internal combustion engine, said engine comprising a cylinder, a water jacket surrounding said cylinder, and a lower face having therein an exhaust outlet port communicating with said cylinder, a water jacket inlet port, a water jacket outlet port, an idle exhaust inlet port, and an idle exhaust outlet port, and said engine also comprising an idle exhaust passage communicating between said idle exhaust inlet port and said idle exhaust outlet port, said propulsion unit also including a drive shaft housing having upper and lower ends, a gearcase connected to said lower end of said drive shaft housing, a propeller rotatably supported by said gearcase, a drive shaft which extends through said drive shaft housing and which includes an upper end driven by said engine and a lower end drivingly connected to said propeller, and an exhaust housing located partially within said drive shaft housing so that said exhaust housing and said drive shaft housing define therebetween a second water jacket, said exhaust housing having upper and lower ends and comprising a flange portion located adjacent said upper end of said exhaust housing, an upper face mating with said lower face of said engine, a continuous, folded exhaust passage located interiorly of said exhaust housing and including a first generally vertical passage portion having an upper end communicating with said exhaust outlet port, and having a lower end, and a second generally vertical passage portion having a lower end communicating with said lower end of said first portion, said exhaust housing also comprising an exhaust outlet located adjacent said lower end of said exhaust housing and communicating with said folded exhaust passage, a water discharge port located adjacent said lower end of said exhaust housing, a side wall, an overflow Port located in said side wall and communicating with said second water jacket, a water discharge passage located interiorly of said exhaust housing and communicating between said overflow port and said water discharge port, a water outlet passage communicating between said water jacket outlet port and said second water jacket, a water intake port located adjacent said lower end of said exhaust housing, a water intake passage located interiorly of said exhaust housing and communicating between said water intake port and said water jacket inlet port, an idle exhaust outlet port, a first idle exhaust passage communicating between said first passage portion and said engine idle exhaust inlet port, and a second exhaust passage communicating between said engine idle exhaust outlet port and said exhaust housing idle exhaust outlet port, muffler means removably mounted on said exhaust housing and communicating with said exhaust housing idle exhaust outlet port, a water Pump having an outlet communicating with said water intake port, and means for sandwiching said exhaust housing flange portion between said upper end of said drive shaft housing and said engine, said sandwiching means including a plurality of bolts extending from said upper end of said drive shaft housing, through said flange portion of said exhaust housing and into said engine.

25. An exhaust housing for use with a marine propulsion device including a drive shaft housing, and an internal combustion engine including an engine block, the engine block including a cylinder, and a lower face having therein an exhaust outlet port communicating with the cylinder, said exhaust housing being of one piece construction and adapted to be located at least partially within the drive shaft housing and comprising an upper face adapted to mate with the lower face of the engine block, an outer wall extending downwardly from said upper face, and wall means located interiorly of said outer wall and defining an exhaust passage located interiorly of said outer wall and adapted to communicate with the exhaust outlet port.

26. An exhaust housing for use with a marine propulsion device including a drive shaft housing, and an internal combustion engine including a cylinder, and a lower face having therein an exhaust outlet port communicating with the cylinder, said exhaust housing being adapted to be located at least partially within the drive shaft housing so that said exhaust housing and the drive shaft housing define therebetween a water jacket, and said exhaust housing comprising an uPper face adapted to be connected to the lower face of the engine, an exhaust passage located interiorly of said exhaust housing and adapted to communicate with the exhaust outlet port, a rear wall, a side wall extending transversely to said rear wall, an overflow port located in said side wall, a water discharge port, and a water discharge passage located interiorly of said exhaust housing and communicating between said overflow port and said water discharge port.

27. An exhaust housing for use with a marine propulsion device including a drive shaft housing, and an internal combustion engine including a cylinder, and a lower face having therein an exhaust outlet port communicating with the cylinder, an idle exhaust inlet port, and an idle exhaust outlet port, and the engine also including an idle exhaust passage communicating between the idle exhaust inlet port and the idle exhaust outlet port, said exhaust housing being adapted to be located at least partially within the drive shaft housing and comprising an upper face adapted to be connected to the lower face of the engine, an exhaust passage located interiorly of said exhaust housing and adapted to communicate with the exhaust outlet port, an idle exhaust outlet port, a first idle exhaust passage communicating with said exhaust Passage and adapted to communicate with the engine idle exhaust inlet port, and a second idle exhaust passage adapted to communicate with the engine idle exhaust outlet port and communicating with said exhaust housing idle exhaust outlet port.

28. An exhaust housing assembly for use with a marine propulsion device including a drive shaft housing, and an internal combustion engine including a cylinder, and a lower face having therein an exhaust outlet port communicating with the cylinder, said exhaust housing assembly being adapted to be located at least partially within the drive shaft housing, and said assembly comprising an exhaust housing including an upper face adapted to be connected to the lower face of the engine, an exhaust passage located interiorly of said exhaust housing and adapted to communicate with the exhaust outlet port, and an idle exhaust outlet port communicating with said exhaust passage when said exhaust housing is connected to the engine, and muffler means removably mounted on said exhaust housing and communicating with said idle exhaust outlet port.

29. An exhaust housing for use with a marine propulsion device including a drive shaft housing having an upper end, and an internal combustion engine including a cylinder, and a lower face having therein an exhaust outlet port communicating with the cylinder, said exhaust housing being adapted to be located partially within the drive shaft housing, being of one piece construction and comprising an upper face adapted to be connected to the lower face of the engine, a flange portion located adjacent said upper face and being adapted to be sandwiched between the upper end of the drive shaft housing and the engine, an outer wall extending downwardly from said upper face, and walls means located interiorly of said outer wall and defining an exhaust passage located interiorly of said outer wall and adapted to communicate with the exhaust outlet port.

30. An internal combustion engine comprising a cylinder, and a lower face having therein an exhaust outlet port communicating with said cylinder, an idle exhaust inlet port, and an idle exhaust outlet port, and said engine also comprising an idle exhaust passage communicating between said idle exhaust inlet port and said idle exhaust outlet port.

31. A marine propulsion device comprising an engine and exhaust housing assembly including an internal combustion engine, said engine comprising a cylinder, and a lower face having therein an exhaust outlet port communicating with said cylinder, and said assembly also including an exhaust housing connected to said lower face of said engine, said exhaust housing comprising a continuous, folded exhaust passage located interiorly of said exhaust housing and including a first generally vertical passage portion having an upper end communicating with said exhaust outlet port, and having a lower end, and a second generally vertical passage portion having a lower end communicating with said lower end of said first portion, said exhaust housing also comprising an exhaust outlet located adjacent said lower end of said exhaust housing and communicating with said folded exhaust passage, and an idle exhaust outlet port, and said assembly further including exhaust passage means extending interiorly of said assembly and communicating between said first passage portion and said idle exhaust outlet port, and said marine propulsion device also comprising a drive shaft housing having a lower end, a gearcase connected to said lower end of said drive shaft housing, a propeller shaft rotatably supported by said gearcase, and a drive shaft which extends through said drive shaft housing and which includes an upper end driven by said engine and a lower end drivingly connected to said propeller shaft.

32. A marine propulsion device as set forth in claim 31 wherein said exhaust housing also includes an upper end, and a flange portion located adjacent said upper end, wherein said drive shaft extends through said flange portion, wherein said drive shaft housing has an upper end, and wherein said marine propulsion device further comprises means for sandwiching said flange portion between said upper end of said drive shaft housing and said engine.

33. A marine propulsion device as set forth in claim 31 wherein said engine also comprises a first water jacket, and a water jacket outlet port communicating with said first water jacket, wherein said exhaust housing and said drive shaft housing define therebetween a second water jacket, and wherein said exhaust housing further includes a water outlet passage communicating between said water jacket outlet port and said second water jacket.

34. A marine propulsion device comprising an internal combustion engine including an engine block comprising a cylinder, a first water jacket, a water jacket outlet port communicating with said first water jacket, and a lower face having therein an exhaust outlet port communicating with said cylinder, a drive shaft housing, a propeller shaft rotatably supported by said drive shaft housing and adapted to support a propeller, a drive shaft extending through said drive shaft housing and including an upper end driven by said engine and a lower end drivingly connected to said propeller shaft, and an exhaust housing located at least partially within said drive shaft housing so that said exhaust housing and said drive shaft housing define therebetween a second water jacket, said exhaust housing including an exhaust passage communicating with said exhaust outlet port, an upper end, a flange portion located adjacent said upper end, and a water drainage passageway extending through said flange portion and communicating between said water jacket outlet port and said second water jacket.

35. A marine propulsion device as set forth in claim 34 wherein said drive shaft housing has an upper end, and wherein said marine propulsion device further comprises means for sandwiching said flange portion between said upper end of said drive shaft housing and said engine block.

36. An exhaust housing for use with a marine propulsion device including an internal combustion engine including an engine block comprising a cylinder, a first water jacket, a water jacket outlet port communicating with the first water jacket, and a lower face having therein an exhaust outlet port communicating with the cylinder, a drive shaft housing, a propeller shaft rotatably supported by the drive shaft housing and adapted to support a propeller, and a drive shaft extending through the drive shaft housing and including an upper end driven by the engine and a lower end drivingly connected to the propeller shaft, said exhaust housing being adapted to be located at least partially within the drive shaft housing so that said exhaust housing and the drive shaft housing define therebetween a second water jacket, and said exhaust housing comprising an exhaust passage adapted to communicate with the exhaust outlet port, an upper end, a flange portion located adjacent said upper end, and a water drainage passageway extending through said flange portion and adapted to communicate between the water jacket outlet port and the second water jacket.

* * * * *